US011594352B2

(12) United States Patent
Maehara

(10) Patent No.: US 11,594,352 B2
(45) Date of Patent: Feb. 28, 2023

(54) METHOD OF PRODUCING MAGNETIC POWDER

(71) Applicant: NICHIA CORPORATION, Anan (JP)

(72) Inventor: Hisashi Maehara, Itano-gun (JP)

(73) Assignee: NICHIA CORPORATION, Anan (JP)

( * ) Notice: Subject to any disclaimer, the term of this patent is extended or adjusted under 35 U.S.C. 154(b) by 334 days.

(21) Appl. No.: 17/033,775

(22) Filed: Sep. 26, 2020

(65) Prior Publication Data

US 2021/0098161 A1 Apr. 1, 2021

(30) Foreign Application Priority Data

Sep. 27, 2019 (JP) ..... JP2019-177609

(51) Int. Cl.
*H01F 1/057* (2006.01)
*H01F 41/02* (2006.01)
*H01F 1/059* (2006.01)

(52) U.S. Cl.
CPC ..... *H01F 1/0578* (2013.01); *H01F 1/059* (2013.01); *H01F 41/026* (2013.01); *H01F 41/0266* (2013.01)

(58) Field of Classification Search
CPC ..... H01F 1/059; H01F 1/061; H01F 1/083; H01F 41/0226; H01F 41/026
See application file for complete search history.

(56) References Cited

U.S. PATENT DOCUMENTS 6,326,087 B1 * 12/2001 Nishiuchi ..... H01F 41/026 428/472
2017/0186519 A1 * 6/2017 Maehara ..... B22F 9/24

FOREIGN PATENT DOCUMENTS

| | | | |
|---|---|---|---|
| JP | H08111306 | A | 4/1996 |
| JP | 2000-309802 | * | 11/2000 |
| JP | 2000309802 | A | 11/2000 |
| JP | 2007329294 | A | 12/2007 |
| JP | 2011119385 | A | 6/2011 |
| JP | 2017117937 | A | 6/2017 |

* cited by examiner

*Primary Examiner* — C Melissa Koslow

(74) *Attorney, Agent, or Firm* — Hunton Andrews Kurth LLP

(57) ABSTRACT

The present disclosure provides a method of producing a magnetic powder capable of providing a bonded magnet having a high remanence. The present disclosure relates to a method of producing a magnetic powder, including: 1) mixing an alkyl silicate with an acidic solution; 2) mixing the resultant alkyl silicate mixture with a SmFeLaN anisotropic magnetic powder; and 3) mixing the resultant magnetic powder mixture with an alkali solution.

10 Claims, No Drawings

METHOD OF PRODUCING MAGNETIC POWDER

CROSS-REFERENCE TO RELATED PATENT APPLICATION

This application claims priority to Japanese Patent Application No. 2019-177609 filed on Sep. 27, 2019. The disclosure of Japanese Patent Application No. 2019-177609 is hereby incorporated by reference in its entirety.

BACKGROUND

Technical Field

The present invention relates to a method of producing a magnetic powder.

Description of Related Art

JP 2017-117937 A discloses a rare earth magnetic powder containing lanthanum.

JP 2000-309802 A discloses a method of hydrolyzing and condensing a mixture of a rare earth magnetic powder and an alkyl silicate under basic conditions.

SUMMARY

The present invention aims to provide a method of producing a magnetic powder capable of providing a bonded magnet having a high remanence.

Embodiments of the present disclosure relate to a method of producing a magnetic powder, including:

1) mixing an alkyl silicate with an acidic solution;

2) mixing a resultant alkyl silicate mixture with a SmFeLaN anisotropic magnetic powder; and 3) mixing a resultant magnetic powder mixture with an alkali solution.

Further embodiments of the present disclosure relate to a method of preparing a bonded magnet compound, including:

1) mixing an alkyl silicate with an acidic solution;

2) mixing a resultant alkyl silicate mixture with a SmFeLaN anisotropic magnetic powder;

3) mixing a resultant magnetic powder mixture with an alkali solution; and 4) mixing a resultant magnetic powder from 3) with a thermoplastic resin.

Still further embodiments of the present disclosure relate to a method of producing a bonded magnet, including:

1) mixing an alkyl silicate with an acidic solution;

2) mixing a resultant alkyl silicate mixture with a SmFeLaN anisotropic magnetic powder;

3) mixing a resultant magnetic powder mixture with an alkali solution;

4) mixing a resultant magnetic powder from 3) with a thermoplastic resin; and 5) subjecting a resultant mixture from 4) to injection molding.

In the method of producing a magnetic powder of the present disclosure, a SmFeLaN anisotropic magnetic powder is used, and an alkyl silicate is hydrolyzed under acidic conditions and then subjected to dehydration condensation under basic conditions in the presence of the magnetic powder. Thus, the method can provide a rare earth magnetic powder having a highly dense silica coating on its surface, which exhibits a high residual magnetization, as well as a bonded magnet compound containing such a rare earth magnetic powder. Moreover, when the bonded magnet compound is used to produce a bonded magnet, its use enables packing of the magnetic powder with high fill factor so that a bonded magnet having a high remanence can be provided.

DETAILED DESCRIPTION

Embodiments of the present invention are described in detail below. The following embodiments, however, are intended as examples to embody the technical idea of the present invention and are not intended to limit the scope of the present invention to the following embodiments. As used herein, the term "step" encompasses not only an independent step but also a step that may not be clearly distinguished from other steps, as long as a desired object of the step is achieved.

The method of producing a magnetic powder according to certain embodiments of the present disclosure includes: 1) mixing an alkyl silicate with an acidic solution; 2) mixing the resultant alkyl silicate mixture with a SmFeLaN anisotropic magnetic powder; and 3) mixing the resultant magnetic powder mixture with an alkali solution.

Step 1)

Step 1) includes mixing an alkyl silicate with an acidic solution. The alkyl silicate is hydrolyzed under acidic conditions, which allows sufficient hydrolysis of the alkyl silicate. The acidic conditions may be any acidic conditions, where the pH is preferably at least 2 and not higher than 6, more preferably at least 2.5 and not higher than 5.0, still more preferably at least 3 and not higher than 4. A pH of lower than 2 tends to cause dissolution of the magnetic powder, thereby resulting in a reduction in magnetic properties and oxidation resistance. A pH of higher than 6 tends not to allow sufficient hydrolysis of the alkyl silicate.

The alkyl silicate may be a silicate represented by the following formula:

$$Si_nO_{(n-1)}(OR)_{(2n+2)}$$

wherein R represents an alkyl group, and n represents an integer of 1 to 10. Examples of the alkyl group include methyl, ethyl, propyl, and butyl groups. A specific preferred example of the alkyl silicate is ethyl silicate because of its inexpensive cost and simple handling without toxicity. The value of n, which affects the molecular weight of the alkyl silicate, is preferably at least 1 and not greater than 10. When n is greater than 10, it is difficult to form a dense silica thin film.

The acidic solution is a solution in which an acid is dissolved in a solvent and which functions as an acid catalyst to promote the hydrolysis of an alkyl silicate. Examples of the acid include acetic acid, hydrochloric acid, phosphoric acid, nitric acid, and sulfuric acid. Among these, acetic acid, hydrochloric acid, and phosphoric acid are preferred. Of these, acetic acid is particularly preferred because of its easy removal during drying. Examples of the solvent include water and ethanol, with water being preferred among these. The acidic solution may have any acidic pH which is preferably at least 3 and not higher than 4. With a pH of lower than 3, the resultant alkyl silicate tends to deteriorate the magnetic properties of the rare earth magnetic powder when mixed therewith in step 2). With a pH of higher than 4, the hydrolysis of the alkyl silicate tends not to be sufficient. The amount of the acidic solution may be at least 5 parts by mass and not more than 100 parts by mass, preferably at least 10 parts by mass and not more than 80 parts by mass, relative to 100 parts by mass of the alkyl silicate. An amount of less than 5 parts by mass tends to lead to insufficient hydrolysis, while an amount of more than 100 parts by mass tends to result in poor miscibility with the magnetic powder.

An alcohol may be mixed simultaneously with the acidic solution to promote the hydrolysis of the alkyl silicate with the acidic solution. This also enhances compatibility with the SmFeLaN anisotropic magnetic powder used in step 2). Examples of the alcohol include ethanol and methanol. The amount of the alcohol added may be in the range of at least 30 parts by mass and not more than 200 parts by mass, preferably at least 40 parts by mass and not more than 80 parts by mass, more preferably at least 50 parts by mass and not more than 60 parts by mass, relative to 100 parts by mass of the alkyl silicate. An amount of less than 30 parts by mass tends to lead to insufficient hydrolysis, while an amount of more than 200 parts by mass tends to result in poor miscibility with the magnetic powder. Substantial completion of the hydrolysis may be indicated by the change of the mixture of the alkyl silicate, the acidic solution, and the alcohol from cloudy to transparent.

The amount of the alcohol added in the hydrolysis is preferably at least 0.1 times and not greater than 3 times, more preferably at least 0.5 times and not greater than 2 times, relative to the theoretical amount required for the hydrolysis of the alkyl silicate. The alcohol is most preferably added in an amount equivalent to the theoretical amount. With an amount of less than 0.1 times, the hydrolysis tends not to result in formation of a dense silica thin film, while with an amount of greater than 3 times, the rare earth magnetic powder tends to be oxidized.

Step 2)

Step 2) includes mixing the alkyl silicate mixture obtained in step 1) with a SmFeLaN anisotropic magnetic powder. This may coat the surface of the magnetic powder with the alkyl silicate.

The coating of the surface of the magnetic powder with the alkyl silicate is preferably carried out in a high speed shear mixer under dry conditions. The coating may be accomplished by applying a silica sol uniformly to the surface of the magnetic powder particles while vigorously stirring and dispersing the magnetic powder by the shear force of the mixer, without depending only on the wettability of the alkyl silicate. The oxidation resistance of the resulting silica film is greatly affected by whether a silica sol is distributed as evenly and uniformly as possible in this step.

The SmFeLaN anisotropic magnetic powder is not limited as long as it contains Sm, Fe, La, and N. A preferred example is a magnetic powder represented by the formula below. This magnetic powder may be produced as disclosed in JP 2017-117937 A. From the standpoint of miscibility with the alkyl silicate, the SmFeLaN anisotropic magnetic powder is preferably formed from a precipitate containing Sm, Fe, and La. For example, the precipitate may be formed by preparing a solution containing Sm, Fe, and La followed by adding an alkali such as ammonia. The precipitate may be subjected to oxidation, pretreatment, reduction and diffusion, and nitridization to obtain a SmFeLaN anisotropic magnetic powder.

$$Sm_{V-X}Fe_{(100-V-W-Z)}N_wLa_xW_z$$

In the formula, $3 \leq v \cdot x \leq 30$, $5 \leq w \leq 15$, $0.08 \leq x \leq 0.3$, and $0 \leq z \leq 2.5$.

If the value of "v−x" in the formula is smaller than 3 at %, the unreacted iron component (α-Fe phase) may be separated, so that the coercive force of the nitride may decrease, failing to provide a practical magnet. If the value is greater than 30 at %, the element Sm may precipitate and make the magnetic powder unstable in the air, thereby resulting in a decrease in remanence. Moreover, if the nitrogen content is smaller than 5 at %, almost no coercive force may be obtained, while if it is greater than 15 at %, the element Sm or Fe itself may form a nitride. From a magnetic property standpoint, preferred compositions are: $Sm_{9.1}Fe_{77.2}N_{13.55}La_{0.15}$ with z=0; and $Sm_{9.0}Fe_{76.9}N_{13.6}La_{0.16}W_{0.34}$ with z>0.

The value of x in the formula is $0.08 \leq x \leq 0.3$, preferably $0.11 \leq x \leq 0.22$, particularly preferably $0.15 \leq x \leq 0.19$, from a magnetic property standpoint. Also, the value of z is $0 \leq z \leq 2.5$ from a magnetic property standpoint.

The amount of the alkyl silicate mixed is preferably at least 1 part by mass and not more than 4 parts by mass, more preferably at least 1.5 parts by mass and not more than 2.5 parts by mass, relative to 100 parts by mass of the magnetic powder. When the amount of the alkyl silicate is less than 1 part by mass relative to 100 parts by mass of the magnetic powder, the alkyl silicate may be insufficient to sufficiently coat the magnetic powder. When the amount of the alkyl silicate is more than 4 parts by mass relative to 100 parts by mass of the magnetic powder, the resulting silica tends to aggregate during dehydration condensation, resulting in a reduction in magnetic properties.

Step 3)

Step 3) includes mixing the rare earth magnetic powder mixture obtained in step 2) with an alkali solution. In step 3), the hydrolysate of the alkyl silicate is subjected to dehydration condensation under basic conditions, which allows a sufficient dehydration condensation reaction. Upon completion of step 3), a rare earth magnetic powder in which a silica thin film is formed on the surface is produced. The basic conditions may be any basic conditions, where the pH is preferably at least 9 and not higher than 13, more preferably at least 10 and not higher than 13. A pH of lower than 9 tends not to allow sufficient dehydration condensation, while a pH of higher than 13 tends to deteriorate the magnetic properties of the rare earth magnetic powder.

The alkali solution may be a solution in which an alkali component is dissolved in a solvent and which functions as a basic catalyst to promote the dehydration condensation of a hydrolysate of an alkyl silicate. Examples of the alkali component include ammonia, hydroxides of alkali metals or alkaline earth metals, and metal hydroxides other than the foregoing hydroxides. Among these, ammonia is particularly preferred because it can be readily volatilized by heating. Examples of the solvent include water and ethanol, with water being preferred among these. The alkali solution may have any basic pH which is preferably 9 or higher. A pH of lower than 9 tends to lead to insufficient dehydration condensation.

In step 3), a silica thin film having a three-dimensional network structure is formed on the surface of the rare earth magnetic powder particles. Step 3) may be followed by heating in order to cause a polycondensation reaction of the remaining SiOH groups to stabilize the silica thin film so that it can become more rigid. The heating temperature is not limited and is preferably at least 60° C. and not higher than 250° C., more preferably at least 100° C. and not higher than 250° C.

The addition of the alkali solution in step 3) may be accompanied by or followed by addition of a tungstate or vanadate. The addition of a tungstate or vanadate can prevent aggregation of the silica produced by hydrolysis/condensation of the alkyl silicate, thereby improving residual magnetization. If this addition is performed before the addition of the alkali solution in step 3), aggregation of the silica tends to occur.

The cation of the tungstate or vanadate is not limited, and examples include ammonium, sodium, and potassium. Among these, ammonium is preferred because it volatilizes during the process and does not remain in the material.

The amount of the tungstate or vanadate added is preferably equivalent to at least 0.01 parts by mass and not more than 0.5 parts by mass, more preferably at least 0.05 parts by mass and not more than 0.3 parts by mass of tungsten or vanadium relative to 100 parts by mass of the rare earth magnetic powder. An amount of less than 0.01 parts by mass is small and tends to have a small effect in preventing aggregation of the powder by forming complexes, while an amount of more than 0.5 parts by mass tends to lead to a reduction in magnetic properties.

The tungstate or vanadate may be added in a solid state. Preferably, it is added in the form of an aqueous solution to achieve uniform mixing.

The resulting silica thin film, when coated at a thickness in the range of at least 0.001 μm and not greater than 0.5 μm, improves oxidation resistance without impairing magnetic properties. The thickness of the silica thin film is more preferably at least 0.001 μm and not greater than 0.2 μm. The thickness of the silica thin film can be measured from TEM images of the cross-sections of the particles.

Moreover, the silica content of the rare earth magnetic powder produced by the method of the present disclosure is preferably at least 0.1% by mass and not higher than 0.5% by mass, more preferably at least 0.20% by mass and not higher than 0.35% by mass. With a content of lower than 0.1% by mass, the silica may not sufficiently coat the rare earth magnetic powder, while with a content of higher than 0.5% by mass, the silica tends to aggregate, resulting in a reduction in magnetic properties. The Si content may be determined by ICP-AES.

The total carbon content (TC) of the rare earth magnetic powder produced by the method of the present disclosure is preferably 1500 ppm or lower, more preferably 1000 ppm or lower. With a content of higher than 1500 ppm, some unreacted alkyl silicate tends to be left and aggregated, resulting in a reduction in magnetic properties. The total carbon content can be determined by TOC.

The rare earth magnetic powder produced by the method of the present disclosure has better oxidation resistance while maintaining the magnetic properties, especially high residual magnetization and coercivity, as compared to powders produced by conventional methods.

Phosphate Treatment Step

In certain embodiments of the present disclosure, step 2) may be preceded by subjecting the SmFeLaN anisotropic magnetic powder to phosphate treatment. The phosphate treatment of the rare earth magnetic powder results in formation of a passive film having a P—O bond on the surface of the rare earth magnetic powder.

In the phosphate treatment step, the rare earth magnetic powder is reacted with a phosphate treatment agent. Examples of the phosphate treatment agent include orthophosphoric acid, sodium dihydrogen phosphate, potassium dihydrogen phosphate, ammonium dihydrogen phosphate, diammonium hydrogen phosphate, zinc phosphate, calcium phosphate, and other phosphates, hypophosphorous acid and hypophosphites, pyrophosphoric acid, polyphosphoric acid, and other inorganic phosphoric acids, and organic phosphoric acids, and salts thereof. Such a phosphate source may basically be dissolved in water or an organic solvent such as IPA, optionally supplemented with a reaction accelerator such as nitrate ions or a grain refiner such as V ions, Cr ions, or Mo ions, and the rare earth magnetic powder may be introduced into the resulting phosphate bath to form a passive film having a P—O bond on the surface of the magnetic powder.

Silane Coupling Agent Treatment Step

In certain embodiments of the present disclosure, step 3) may be followed by treating with a silane coupling agent. When the rare earth magnetic powder with a silica thin film is treated with a silane coupling agent, a coupling agent film is formed on the silica thin film, which improves the magnetic properties of the rare earth magnetic powder as well as wettability between the magnetic powder and the resin and magnet strength. The silane coupling agent is not limited and may be selected according to the type of resin. Examples of the silane coupling agent include γ-(2-aminoethyl)aminopropyltrimethoxysilane, γ-(2-aminoethyl)aminopropylmethyldimethoxysilane, γ-methacryloxypropyltrimethoxysilane, γ-methacryloxypropylmethyldimethoxysilane, N-ß-(N-vinylbenzylaminoethyl)-γ-aminopropyltrimethoxysilane hydrochloride, γ-glycidoxypropyltrimethoxysilane, γ-mercaptopropyltrimethoxysilane, methyltrimethoxysilane, methyltriethoxysilane, vinyltriacetoxysilane, γ-chloropropyltrimethoxysilane, hexamethylenedisilazane, γ-anilinopropyltrimethoxysilane, vinyltrimethoxysilane, octadecyl[3-(trimethoxysilyl)propyl]ammonium chloride, γ-chloropropylmethyldimethoxysilane, γ-mercaptopropylmethyldimethoxysilane, methyltrichlorosilane, dimethyldichlorosilane, trimethylchlorosilane, vinyltrichlorosilane, vinyl tris(ß-methoxyethoxy)silane, vinyltriethoxysilane, ß-(3,4-epoxycyclohexyl)ethyltrimethoxysilane, γ-glycidoxypropylmethyldiethoxysilane, N-ß-(aminoethyl)-γ-aminopropyltrimethoxysilane, N-ß-(aminoethyl)-γ-aminopropylmethyldimethoxysilane, γ-aminopropyltriethoxysilane, N-phenyl-γ-aminopropyltrimethoxysilane, ureidopropyltriethoxysilane, γ-isocyanatopropyltriethoxysilane, polyethoxydimethylsiloxane, polyethoxymethylsiloxane, bis(trimethoxysilylpropyl)amine, bis(3-triethoxysilylpropyl) tetrasulfane, γ-isocyanatopropyltrimethoxysilane, vinylmethyldimethoxysilane, 1,3,5-N-tris(3-trimethoxysilylpropyl)isocyanurate, t-butyl carbamate trialkoxysilane, and N-(1,3-dimethylbutylidene)-3-(triethoxysilyl)-1-propaneamine. One of these silane coupling agents may be used alone, or two or more thereof may be used in combination. The amount of the silane coupling agent added is preferably at least 0.2 parts by mass and not more than 0.4 parts by mass, more preferably at least 0.25 parts by mass and not more than 0.35 parts by mass, relative to 100 parts by mass of the rare earth magnetic powder. With an amount of less than 0.2 parts by mass, the silane coupling agent tends to have a small effect, while with an amount of more than 0.4 parts by mass, aggregation of the rare earth magnetic powder tends to occur, resulting in a reduction in the magnetic properties of the rare earth magnetic powder and the rare earth magnet.

The SmFeLaN anisotropic magnetic powder preferably has an average particle size of at least 3.9 μm and not greater than 6 μm, more preferably at least 4 μm and not greater than 5 μm. With an average particle size of smaller than 3.9 μm, the magnetization tends to be reduced, while with an average particle size of greater than 6 μm, the multidomain state tends to occur, resulting in a reduction in magnetic properties. Herein, the average particle size is defined as the particle size corresponding to the 50th percentile by volume from the smallest particle size in a particle size distribution.

The method of preparing a bonded magnet compound according to an embodiment of the present disclosure includes: 1) mixing an alkyl silicate with an acidic solution;

2) mixing the resultant alkyl silicate mixture with a SmFeLaN anisotropic magnetic powder; 3) mixing the resultant magnetic powder mixture with an alkali solution; and 4) mixing the resultant magnetic powder from 3) with a thermoplastic resin.

Steps 1) to 3) are as described above.

Step 4)

Step 4) includes mixing a thermoplastic resin with the magnetic powder obtained by drying the magnetic powder mixture obtained in step 3).

Any thermoplastic resin may be used, and examples include polypropylene, polyethylene, polyvinyl chloride, polyester, polyamide, polycarbonate, polyphenylene sulfide, and acrylic resins. Among these, polyamide resins are preferred, with nylon 12 (polyamide 12) being more preferred because it is a crystalline resin having a relatively low melting point and a low water absorption rate and thus shows good moldability. Moreover, these resins may be used in admixture as appropriate.

The amount of the SmFeLaN anisotropic magnetic powder is preferably at least 62% by volume, more preferably at least 63% by volume of the bonded magnet compound. An amount of less than 62% by volume tends to lead to a reduction in magnetic properties.

The method of producing a bonded magnet according to an embodiment of the present disclosure includes: 1) mixing an alkyl silicate with an acidic solution; 2) mixing the resultant alkyl silicate mixture with a SmFeLaN anisotropic magnetic powder; 3) mixing the resultant magnetic powder mixture with an alkali solution; 4) mixing the resultant magnetic powder from 3) with a thermoplastic resin; and 5) subjecting the resultant mixture from 4) to injection molding.

Steps 1) to 4) are as described above.

Step 5)

Step 5) includes subjecting the bonded magnet compound obtained in step 4) to injection molding. The temperature for injection molding is not limited and may be selected appropriately according to the processing temperature of the thermoplastic resin used.

EXAMPLES

Examples are described below. It should be noted that "%" is by mass unless otherwise specified.

Example 1

Dissolution Step $FeSO_4.7H_2O$ (5 kg) was mixed and dissolved in pure water (20 kg). Then, $Sm_2O_3$ (0.48 kg), a 31.8% $LaCL_3$ solution (0.071 kg), and a 70% sulfuric acid solution (0.72 kg) were added to the mixture and completely dissolved with adequate stirring. Next, pure water was added to the resultant solution to adjust the final Fe, Sm, and La concentrations to 0.726 mol/L, 0.109 mol/L, and 0.0063 mol/L, respectively, to prepare a Fe—Sm—La sulfuric acid solution.

Precipitation Step

The whole amount of the Fe—Sm—La sulfuric acid solution obtained in the dissolution step was added dropwise with stirring to pure water (20 kg) maintained at 40° C. over 70 minutes from the start of the reaction. At the same time, a 15% ammonia solution was added dropwise to adjust the pH to 7 to 8. Thus, a slurry containing a Fe—Sm—La hydroxide was obtained. The slurry was washed with pure water by decantation, followed by separating the hydroxide by solid-liquid separation. The separated hydroxide was dried in an oven at 100° C. for 10 hours.

Oxidation Step

The hydroxide obtained in the precipitation step was fired in the air at 900° C. for one hour. After cooling, a red Fe—Sm—La oxide was obtained as starting powder.

Pretreatment Step

The Fe—Sm—La oxide (100 g) obtained as above was put into a steel vessel to a bulk height of 10 mm. The vessel was placed in a furnace, and the pressure was decreased to 100 Pa. Then, the vessel was heated to a pretreatment temperature of 850° C. while introducing hydrogen gas, and this temperature was maintained for 15 hours. The oxygen concentration of the product was measured by non-dispersive infrared spectroscopy (ND-IR) (EMGA-820 available from HORIBA, Ltd.) and found to be 5% by mass. This shows that a black partial oxide was obtained in which the oxygen bonded to Sm remained unreduced while 95% of the oxygen bonded to Fe was reduced.

Reduction Step

The partial oxide (60 g) obtained in the pretreatment step and metallic calcium (19.2 g) having an average particle size of about 6 mm were mixed together and placed in a furnace. After the furnace was vacuum evacuated, argon gas (Ar gas) was introduced. The temperature was increased to a first temperature of 1045° C. and maintained for 45 minutes, and then cooled to a second temperature of 1000° C. and maintained for 30 minutes. Thus, Fe—Sm—La alloy particles were obtained.

Nitridization Step

Subsequently, the interior of the furnace was cooled to 100° C. and then vacuum evacuated. The temperature was increased to 450° C. while introducing nitrogen gas, and this temperature was maintained for 23 hours. Thus, a bulk product containing magnetic particles was obtained.

Water Washing/Surface Treatment Step

The bulk product obtained in the nitridization step was added to pure water (3 kg), followed by stirring for 30 minutes. After the mixture was allowed to stand, the supernatant was discharged by decantation. The addition to pure water, stirring, and decantation were repeated 10 times. Then, 99.9% acetic acid (2.5 g) was added, followed by stirring for 15 minutes. After the mixture was allowed to stand, the supernatant was discharged by decantation. The addition to pure water, stirring, and decantation were further repeated twice.

Phosphate Treatment Step

A phosphate solution was added to the resultant slurry. The phosphate solution was added in an amount equivalent to 1% by mass of $PO_4$ relative to the solids of the magnetic particles. The mixture was stirred for five minutes, followed by solid-liquid separation and then vacuum drying at 80° C. for three hours to obtain a magnetic powder. The magnetic powder was represented by $Sm_{1.97}Fe_{17}La_{0.03}N_3$.

Si Coating Step

A mixer was charged with an ethyl silicate ($Si_5O_4(OEt)_{12}$, 2.8 g), an acetic acid acidic solution (0.4 g), and ethanol (1.4 g), followed by mixing for one minute in a nitrogen atmosphere. To the resultant ethyl silicate mixture was added the magnetic powder (150 g), and they were mixed for one minute. To the resultant magnetic powder mixture was added ammonia water (2.4 g) having a pH of 12, and they were mixed for one minute. The resultant mixture was taken out of the mixer and heated under reduced pressure at 180° C. for 30 minutes to obtain a $Sm_{1.97}Fe_{17}La_{0.03}N_3$ anisotropic magnetic powder in which a silica thin film was formed on the surface.

To the resultant magnetic powder (300 g) was added a mixed solution containing a silane coupling agent (γ-aminopropyltriethoxysilane, 1.2 g), ammonia water (0.6 g, ammonia content: 10% by mass) having a pH of 11.7, and ethanol (3.6 g), and they were mixed in a nitrogen atmosphere for one minute. The resultant mixture was taken out and heated under reduced pressure at 90° C. for 30 minutes to obtain an anisotropic magnetic powder in which a coupling agent film was formed on the silica film (hereinafter CP powder).

The surface-treated anisotropic magnetic powder (92.5% by mass) and polyamide 12 (7.5% by mass) were mixed in a mixer. The resultant powder mixture was kneaded at 220° C. in a twin-screw kneader to prepare a bonded magnet compound, which was then subjected to injection molding to produce a bonded magnet.

Example 2

A SmFeLaN anisotropic magnetic powder (CP powder) was produced as in Example 1, except that the fill factor was changed to 64% by volume. Also, a bonded magnet compound was prepared and subjected to injection molding as in Example 1 to produce a bonded magnet.

Example 3

A SmFeLaN anisotropic magnetic powder (CP powder) was produced as in Example 1, except that the fill factor was changed to 65% by volume.

Also, a bonded magnet compound was prepared and subjected to injection molding as in Example 1 to produce a bonded magnet.

Comparative Example 1

A SmFeN anisotropic magnetic powder (CP powder) was produced as in Example 1, except that no $LaCl_3$ was used. Also, a bonded magnet compound was prepared and subjected to injection molding as in Example 1 to produce a bonded magnet.

Comparative Example 2

A SmFeLaN anisotropic magnetic powder (CP powder) was produced as in Example 1, except that no Si coating was performed. Also, a bonded magnet compound was prepared and subjected to injection molding as in Example 1 to produce a bonded magnet.

The CP powders were measured for residual magnetization (or) and coercive force (iHc) as described below. The bonded magnets were also measured for remanence (Br) and coercive force (ilk) as described below. The results are shown in Table 1.

Residual Magnetization and Coercive Force of Magnetic Powder (CP Powder)

Each CP powder was packed into a sample vessel together with a paraffin wax. After the paraffin wax was melted with a dryer, the easy axes of magnetization were aligned in an orientation field of 16 kA/m. The magnetically oriented sample was pulse magnetized in a magnetizing field of 32 kA/m, and the residual magnetization (or) and coercive force (iHc) of the sample were measured using a vibrating sample magnetometer (VSM) with a maximum field of 16 kA/m.

Remanence and Coercive Force of Bonded Magnet

The remanence (Br) and coercive force (iHc) of each bonded magnet obtained by injection molding were measured using a vibrating sample magnetometer (VSM) with a maximum field of 16 kA/m.

TABLE 1

| | Magnetic powder | | | CP powder | | Bonded magnet | | |
|---|---|---|---|---|---|---|---|---|
| Example No. | Average particle size (μm) | La | Si coating | σr (emu/g) | iHc (Oe) | Fill factor (vol %) | Br (G) | iHc (Oe) |
| Example 1 | 4.26 | Present | Present | 144.3 | 13820 | 62 | 8835 | 11296 |
| Comparative Example 1 | 3.15 | Absent | Present | 135.3 | 21283 | 62 | 8281 | 18555 |
| Comparative Example 2 | 4.10 | Present | Absent | 143.9 | 12700 | 62 | 8880 | 9531 |
| Example 2 | 4.26 | Present | Present | 144.3 | 13820 | 64 | 9027 | 11078 |
| Example 3 | 4.26 | Present | Present | 144.1 | 13320 | 65 | 9067 | 10502 |

In Comparative Example 1 using a magnetic powder free from La, the residual magnetization of the CP powder and the remanence of the bonded magnet were reduced. In Comparative Example 2 including no Si coating, the coercive forces of the CP powder and the bonded magnet were greatly reduced. In contrast, in Example 1 using a magnetic powder containing La and including Si coating, the remanence of the bonded magnet was increased. Moreover, Examples 2 and 3 show that the magnetic powders were packed with higher fill factor, and the remanence of the bonded magnets was further increased.

The rare earth magnetic powder produced by the method of the present invention has better magnetic properties than conventional products, and is thus suitable for use in applications such as bonded magnets.

What is claimed is:

1. A method of producing a magnetic powder, comprising:

1) mixing an alkyl silicate with an acidic solution;

2) mixing a resultant alkyl silicate mixture with a SmFeLaN anisotropic magnetic powder; and 3) mixing a resultant magnetic powder mixture with an alkali solution.

2. The method according to claim 1, wherein the SmFeLaN anisotropic magnetic powder has an average particle size of at least 3.9 μm and not greater than 6 μm.

3. The method according to claim 1, wherein the acidic solution has a pH of at least 3 and not higher than 4.

4. The method according to claim 1, wherein an alcohol is mixed simultaneously with the acidic solution.

5. The method according to claim 1, further comprising, before the step 2), subjecting the SmFeLaN anisotropic magnetic powder to phosphate treatment.

6. The method according to claim 1, further comprising, after the step 3), treating with a silane coupling agent.

7. The method according to claim 1, wherein the SmFeLaN anisotropic magnetic powder is formed from a precipitate containing Sm, Fe, and La.

8. A method of preparing a bonded magnet compound, comprising:

1) mixing an alkyl silicate with an acidic solution;

2) mixing a resultant alkyl silicate mixture with a SmFeLaN anisotropic magnetic powder;

3) mixing a resultant magnetic powder mixture with an alkali solution; and 4) mixing a resultant magnetic powder from 3) with a thermoplastic resin.

9. The method according to claim 8, wherein the bonded magnet compound contains at least 62% by volume of the SmFeLaN anisotropic magnetic powder.

10. A method of producing a bonded magnet, comprising:

1) mixing an alkyl silicate with an acidic solution;

2) mixing a resultant alkyl silicate mixture with a SmFeLaN anisotropic magnetic powder;

3) mixing a resultant magnetic powder mixture with an alkali solution;

4) mixing a resultant magnetic powder from 3) with a thermoplastic resin; and 5) subjecting a resultant mixture from 4) to injection molding.

* * * * *